US006095067A

United States Patent [19]

Tomita et al.

[11] Patent Number: 6,095,067

[45] Date of Patent: Aug. 1, 2000

[54] SEWING APPARATUS

[75] Inventors: Shintaro Tomita; Chiyo Koga; Mika Nitamizu, all of Nagoya, Japan

[73] Assignee: Brother Kogyo Kabushiki Kaisha, Nagoya, Japan

[21] Appl. No.: 09/161,917

[22] Filed: Sep. 29, 1998

[30] Foreign Application Priority Data

Sep. 29, 1997 [JP] Japan ..... 9-264700

[51] Int. Cl.[7] ..... D05B 21/00; D05C 5/04

[52] U.S. Cl. ..... 112/102.5; 112/445

[58] Field of Search ..... 112/102.5, 470.06, 112/475.19, 445, 470.04; 364/470.09; 700/138

[56] References Cited

U.S. PATENT DOCUMENTS 5,228,403 7/1993 Sugimoto ..... 112/102.5

5,474,000 12/1995 Mizuno et al. ..... 112/102.5

FOREIGN PATENT DOCUMENTS

A-59-20194 2/1984 Japan .

*Primary Examiner*—Peter Nerbun

*Attorney, Agent, or Firm*—Oliff & Berridge, PLC

[57] ABSTRACT

A sewing apparatus is provided with: a stitch forming device; a driving device for driving the stitch forming device; a controller for controlling the driving device; and a displaying device comprising a color switch panel including a plurality of transparent switches on a surface of the color switch panel. The transparent switches are divided into a plurality of switch groups, each of which includes at least one transparent switch, depending upon functions of the sewing apparatus corresponding to the transparent switches respectively. The sewing apparatus is further provided with a color display controlling device for controlling the displaying device to perform a color display on the color switch panel by using one color for all of the at least one transparent switch belonging to one of the switch groups and by using another color for all of the at least one transparent switch belonging to another of the switch groups.

16 Claims, 7 Drawing Sheets

SEWING APPARATUS

BACKGROUND OF THE INVENTION

1. Field of the Invention

The present invention relates to a sewing apparatus including a sewing machine, which is provided with a CPU (Central Processing Unit) and which can electronically perform information processing, such as a selection of a pattern to be sewed etc., and automatically perform a sewing process.

2. Description of the Related Art

There is a sewing apparatus including a so-called embroidery sewing machine, which is provided with a built-in microcomputer containing a CPU or which is connected with an external computer so as to control the sewing machine by using the external computer, so that the sewing machine can perform various processes, such as an automatic sewing operation of a desired embroidery and the like, for example, just by selecting a pattern to be embroidered by the use of a touch panel etc., on the sewing machine or by selecting it on the external computer.

In the above mentioned sewing apparatus having the touch panel, all switches, keys, buttons or the like on the touch panel are displayed with a single color (or a monochrome) when the pattern to be embroidered and a position of a sewing needle (that is, a position where the embroidery or the like is actually sewed) are selected or set on the touch panel, for example.

In the above mentioned sewing apparatus controlled by the external computer, all switches, keys, buttons or the like used for the control on a display picture plane on the external computer for the control of the sewing machine are displayed with the single color (or the monochrome).

However, if the selections of the embroidery and the like are executed by using the touch panel, the switches, keys or buttons to perform various initializations (e.g., an initialization of returning to an initial value in the embroidery selection, an initialization of returning to an initialization position in the position setting operation of the sewing needle) are disposed on the touch panel.

Therefore, since all of the switches, keys, buttons or the like including the switches etc., for the initialization are displayed with the same color on the touch panel, a typical user, who does not read an instruction manual thoroughly, operates the switches etc., for the initialization erroneously while setting the position of the sewing needle or selecting the pattern. This results in problems that the sewing needle position set until that time is unexpectedly returned to the original initialization position and that the existent selection of the pattern is unexpectedly initialized (that is, the selection is invalidated).

Moreover, the user usually fixes his or her eyes on the sewing needle when selecting the position of the sewing needle. Thus, there is a problem that even in this case, the position of the sewing needle is unexpectedly initialized by the erroneous operation of the switches etc., for the initialization unless the user knows in advance the position of the switches etc., for the initialization.

This problem similarly exists even in case of setting the position of the sewing needle and selecting the pattern by the external computer or the like.

SUMMARY OF THE INVENTION

The present invention is proposed in view of the above mentioned problems. It is therefore an object of the present invention to provide a sewing apparatus, which can reduce or protect against such an obstacle that a switch, key, button or the like on a display panel is erroneously operated by the user to cause the position of the sewing needle to be unexpectedly returned to the initial position.

The above object of the present invention can be achieved by a first sewing apparatus provided with: a stitch forming device; a driving device for driving the stitch forming device; a controller for controlling the driving device; a displaying device comprising a color switch panel including a plurality of transparent switches on a surface of the color switch panel, the transparent switches being divided into a plurality of switch groups, each of which includes at least one transparent switch, depending upon functions of the sewing apparatus corresponding to the transparent switches respectively; and a color display controlling device for controlling the displaying device to perform a color display on the color switch panel by using one color for all of the at least one transparent switch belonging to one of the switch groups and by using another color for all of the at least one transparent switch belonging to another of the switch groups.

According to the first sewing apparatus, the transparent switches are divided into a plurality of the switch groups depending upon the functions of the sewing apparatus corresponding to the transparent switches respectively. Then, different colors are assigned to the respective switch groups in advance. In operation, the displaying device is controlled by the color display controlling device, so that the displaying device performs the color display on the color switch panel by using one color for all of the at least one transparent switch belonging to one of the switch groups while the displaying device performs the color display on the color switch panel by using another color for all of the at least one transparent switch belonging to another of the switch groups.

Accordingly, since the transparent switches are displayed on the displaying device such that the colors are different on the basis of the functions of the sewing apparatus, each transparent switch can be visually observed for each function, to thereby reduce the probability that each transparent switch is erroneously operated or to protect against the erroneous operation.

Therefore, it is possible to reduce or protect against such an obstacle that the position of the sewing needle is unexpectedly returned to the initial position because of the erroneous operation on the sewing apparatus, for example.

The above object of the present invention can be also achieved by a second sewing apparatus provided with: a stitch forming device; a driving device for driving the stitch forming device; a controller for controlling the driving device; a displaying device comprising a color switch panel including a plurality of transparent switches on a surface of the color switch panel, the transparent switches being divided into a plurality of switch groups, each of which includes at least one transparent switch; a character display controlling device for controlling the displaying device to perform a character display such that each character string, which means respective one of functions of the sewing apparatus corresponding to the transparent switches respectively, is displayed at a position corresponding to respective one of the transparent switches; and a color display controlling device for controlling the displaying device to perform a color display on the color switch panel by using one color for all of the at least one transparent switch belonging to one of the switch groups and by using another color for all of the at least one transparent switch belonging to another of the switch groups such that transparent switches corresponding to character strings, whose meanings are confusing to each other according to a predetermined standard, are displayed by using colors different from each other.

According to the second sewing apparatus, the transparent switches are divided into a plurality of the switch groups. Then, different colors are assigned to the respective switch groups in advance. In operation, the displaying device is controlled by the character display controlling device, so that the displaying device performs the character display. At this time, each character string is displayed at a position corresponding to respective one of the transparent switches. On the other hand, the displaying device is controlled by the color display controlling device, so that the displaying device performs the color display on the color switch panel by using one color for all of the at least one transparent switch belonging to one of the switch groups while the displaying device performs the color display on the color switch panel by using another color for all of the at least one transparent switch belonging to another of the switch groups. At this time, transparent switches corresponding to character strings, whose meanings are confusing to each other according to a predetermined standard, are displayed by using colors different from each other.

Accordingly, since the transparent switches are displayed with the character strings having the mutually confusing meanings on the displaying device such that the colors are different on the basis of the difference of the mutually confusing meanings, it is easy to visually differentiate these transparent switches even through they correspond to the character strings having the mutually confusing meanings, to thereby reduce the probability that each transparent switch is erroneously operated or protect against the erroneous operation.

Therefore, it is possible to reduce or protect against such an obstacle that the sewing manner different from that of the user's intention is unexpectedly performed because of the erroneous operation on the sewing apparatus, for example.

In one aspect of the first or second sewing apparatus of the present invention, the color display controlling device controls the displaying device to perform the color display by using a predetermined color implying a warning for the at least one transparent switch belonging to one switch group having an initializing function which initializes operations having been performed on the sewing apparatus.

According to this aspect, as for the at least one transparent switch having the initializing function, the displaying device performs the color display by using the predetermined color implying the warning.

Accordingly, it is easy to visually recognize the transparent switch having the initializing function, to thereby reduce the probability this transparent switch is erroneously operated (i.e., the probability that the operations having been performed until the present time point are invalidated because of the erroneous initializing operation) or to protect against such an erroneous operation.

In this case, the predetermined color implying the warning may be red. Thus, it is even easier to visually recognize the transparent switch having the initializing function by the red color, to thereby even more reduce the probability this transparent switch is erroneously operated or to more certainly protect against such an erroneous operation.

The above object of the present invention can be achieved by a third sewing apparatus provided with:(i) at least one sewing machine each comprising a stitch forming device and a driving device for driving said stitch forming device, and (ii) a control unit connected to said sewing machine from an external portion of said sewing machine through a communication line. The control unit is provided with: a controller for controlling said driving device; a displaying device comprising a color switch panel including a plurality of transparent switches on a surface of the color switch panel, the transparent switches being divided into a plurality of switch groups, each of which includes at least one transparent switch, depending upon functions of the sewing apparatus corresponding to the transparent switches respectively; and a color display controlling device for controlling the displaying device to perform a color display on the color switch panel by using one color for all of the at least one transparent switch belonging to one of the switch groups and by using another color for all of the at least one transparent switch belonging to another of the switch groups.

According to the third sewing apparatus, the control unit is connected to one or more sewing machines from the external Portion through the communication line, so that the driving device of the sewing machine is controlled by the controller. For example, a plurality of sewing machines are collectively and remotely controlled by the control unit such as a computer connected through a wire or wireless communication line.

Accordingly, in the same manner as the aforementioned first sewing apparatus of the present invention, since the transparent switches are displayed on the displaying device such that the colors are different on the basis of the functions of the sewing apparatus, each transparent switch can be visually observed for each function, to thereby reduce the probability that each transparent switch is erroneously operated or to protect against the erroneous operation in the sewing apparatus including one or more sewing machines and the control unit.

The above object of the present invention can be also achieved by a fourth sewing apparatus provided with (i) at least one sewing machine each comprising a stitch forming device and a driving device for driving the stitch forming device, and (ii) a control unit connected to the sewing machine from an external portion of the sewing machine through a communication line. The control unit is provided with: a controller for controlling the driving device; a displaying device comprising a color switch panel including a plurality of transparent switches on a surface of the color switch panel, the transparent switches being divided into a plurality of switch groups, each of which includes at least one transparent switch; a character display controlling device for controlling the displaying device to perform a character display such that each character string, which means respective one of functions of the sewing apparatus corresponding to the transparent switches respectively, is displayed at a position corresponding to respective one of the transparent switches; and a color display controlling device for controlling the displaying device to perform a color display on the color switch panel by using one color for all of the at least one transparent switch belonging to one of the switch groups and by using another color for all of the at least one transparent switch belonging to another of the switch groups such that transparent switches corresponding to character strings, whose meanings are confusing to each other according to a predetermined standard, are displayed by using colors different from each other.

According to the fourth sewing apparatus, the control unit is connected to one or more sewing machines from the external portion through the communication line, so that the driving device of the sewing machine is controlled by the controller. For example, a plurality of sewing machines are collectively and remotely controlled by the control unit such as a computer connected through a wire or wireless communication line.

Accordingly, in the same manner as the aforementioned second sewing apparatus of the present invention, since the transparent switches are displayed with the character strings having the mutually confusing meanings on the displaying device such that the colors are different on the basis of the difference of the mutually confusing meanings, it is easy to visually differentiate these transparent switches even through they correspond to the character strings having the mutually confusing meanings, to thereby reduce the probability that each transparent switch is erroneously operated or protect against the erroneous operation in the sewing apparatus including one or more sewing machines and the control unit.

In one aspect of the third or fourth sewing apparatus of the present invention, the color display controlling device controls the displaying device to perform the color display by using a predetermined color implying a warning for the at least one transparent switch belonging to one switch group having an initializing function which initializes operations having been performed on the sewing apparatus.

According to this aspect, it is easy to visually recognize the transparent switch having the initializing function, to thereby reduce the probability this transparent switch is erroneously operated or to protect against such an erroneous operation.

In this case, the predetermined color implying the warning may be red. Thus, it is even easier to visually recognize the transparent switch having the initialization function by the red color, to thereby even more reduce the probability this transparent switch is erroneously operated or to more certainly protect against such an erroneous operation.

The nature, utility, and further features of this invention will be more clearly apparent from the following detailed description with respect to preferred embodiments of the invention when read in conjunction with the accompanying drawings briefly described below.

DETAILED DESCRIPTION OF THE PREFERRED EMBODIMENTS

Preferred embodiments of the present invention will be explained below with reference to the drawings.

At first, an appearance of a sewing machine of the embodiment, which is an embroidery sewing machine, is explained with reference to FIG. 1.

Figure 1:
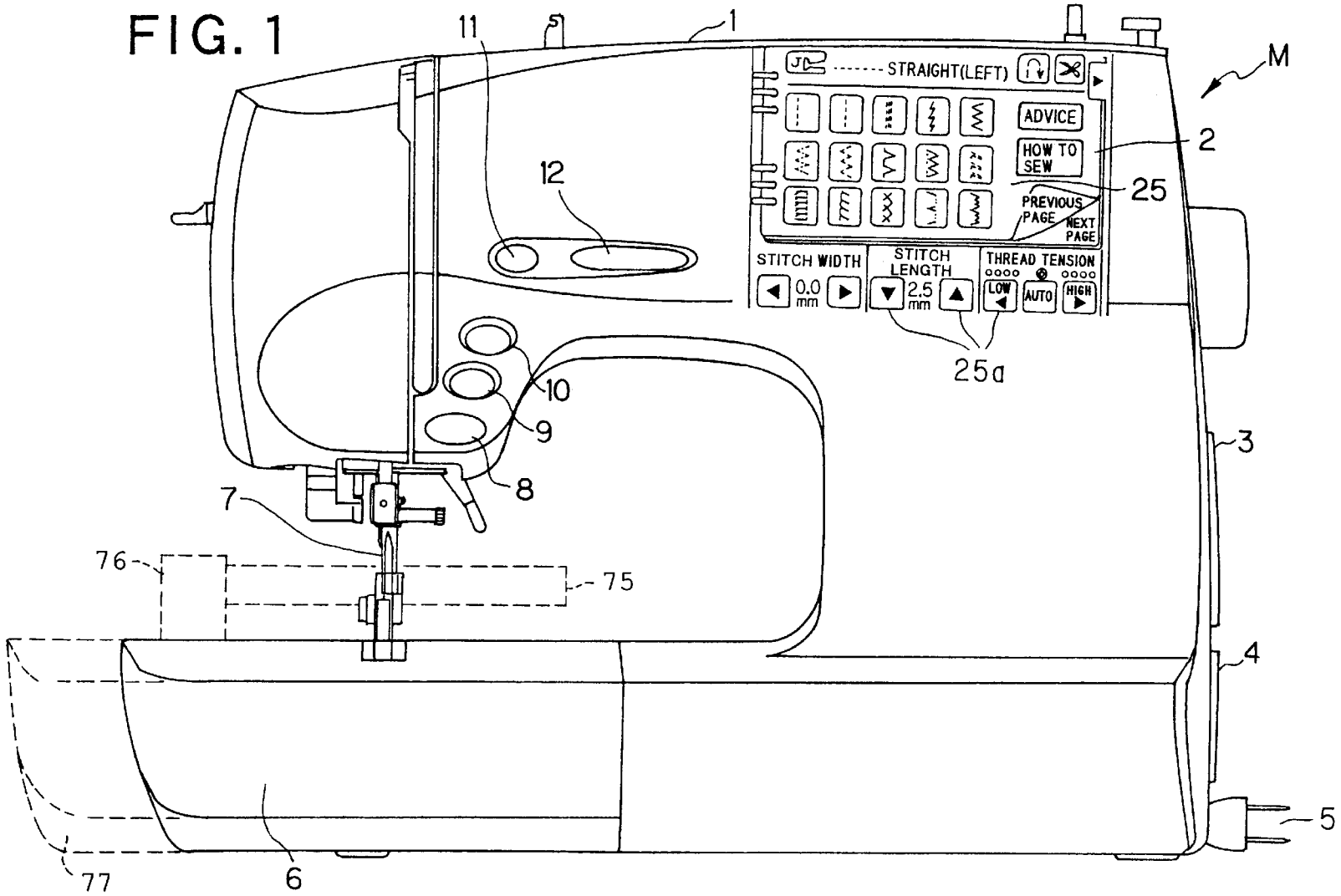
FIG. 1 is a side view showing a schematic configuration of an embroidery sewing machine as an embodiment of the present invention.

In FIG. 1, an embroidery sewing machine M is provided, on a main body 1, with: an LCD (Liquid Crystal Display) panel 2 as one example of a displaying device for displaying an operation status etc., of the embroidery sewing machine M during sewing various embroideries; a card connector 3 to which an external ROM (Read Only Memory) etc., for storing various embroidery patterns set in advance is to be connected; a communication connector 4 for performing transmission and reception of data by connecting an external computer with the embroidery sewing machine M; an electric source cable 5; a cloth fixing platform 6 on which a cloth is fixed during sewing; a sewing needle 7 for actually sewing; a start/stop button 8 operated when the sewing operation is to be started and stopped; a backstitch button 9 operated when a backstitch is performed; a needle up and down button 10 operated when the sewing needle 7 is manually moved up and down; a thread cutting button 11 operated when a thread is cut after sewing etc.; and a motor speed control 12 for adjusting a rotation speed of a motor to move up and down the sewing needle 7.

Incidentally, on a surface of the LCD panel 2, a touch panel 25 is disposed as one example of an inputting device including one or more keys 25*a* to perform various inputting operations.

Further, in the cloth fixing platform 6, a rotating motor for moving the cloth fixed on the cloth fixing platform 6 within a X-Y plane perpendicular to the moving direction of the sewing needle 7 in correspondence with the pattern to be embroidered etc., a loop taker for storing a bobbin thread and so on are accommodated.

When actually sewing a sewing pattern, in addition to the constitutional elements of the embroidery sewing machine M as indicated by a solid line in FIG. 1, the embroidery sewing machine M is provided, as indicated by a dashed line in FIG. 1, with: an embroidery frame 75 for fixing a cloth to which a sewing pattern is to be embroidered; a moving body 76 for moving the embroidery frame 75 in a direction perpendicular to the paper surface of FIG. 1 in correspondence with the sewing pattern to be sewn; and an embroidering device 77 for moving the embroidery frame 75 in a direction parallel to the paper surface of FIG. 1 by moving the moving body 76 in a direction parallel to the paper surface of FIG. 1 in correspondence with the sewing pattern to be sewn. Among those constitutional elements, within the embroidery device 77, an X direction driving motor 23 and a Y direction driving motor 24, which will be described later, for moving the embroidery frame 75 within a plane perpendicular to the moving direction of the sewing needle 7 by driving the moving body 76 and moving the moving body 76 in a direction perpendicular to the paper surface of FIG. 1.

Next, the internal structure of the embroidery sewing machine M is explained with reference to a block diagram shown in FIG. 2.

The operation of the embroidery sewing machine M is concentrically controlled by a signal processing unit 15 within the embroidery sewing machine M.

Figure 2:
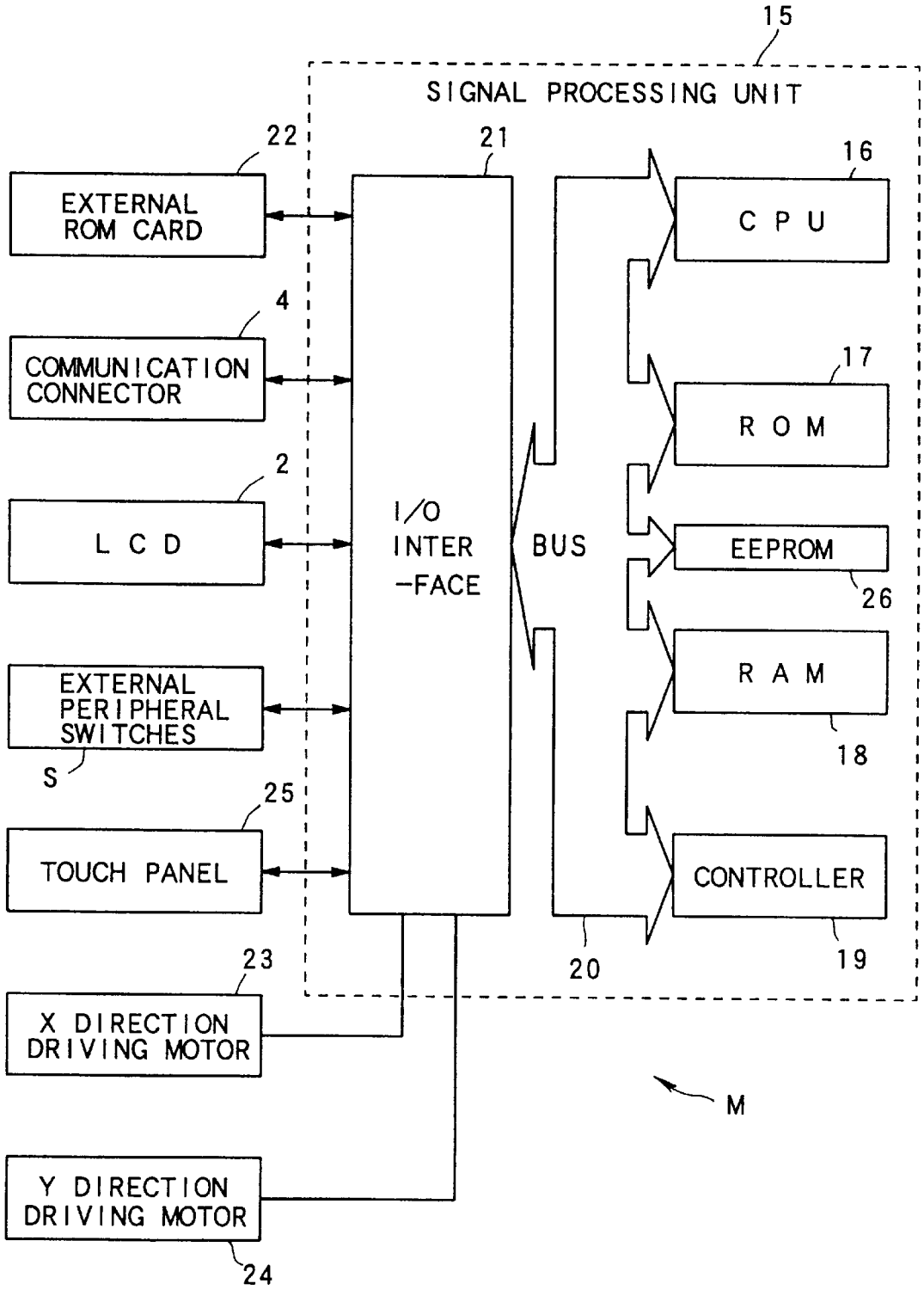
FIG. 2 is a block diagram showing an inner schematic configuration of the embroidery sewing machine.

In FIG. 2, the signal processing unit 15 is provided with: a CPU 16 as one example of a color display controlling device and a character display controlling device for actually performing a control of the embroidery sewing machine M; a ROM 17 for storing a control program for operating the CPU 16 etc., in advance in a readable manner; a RAM (Random Access Memory) 18 for temporarily storing data necessary for controlling the embroidery sewing machine M etc., in a readable manner; a communication bus 20 for connecting each constitutional element within the signal processing unit 15; a controller 19 for controlling the connections between the constitutional elements respectively by the communication bus 20 and an input/output (I/O) interface 21; and the input/output interface 21 for connecting the signal processing unit 15 with external constitutional elements.

Then, the signal processing unit 15 is connected through the input/output interface 21 with: an external ROM card 22 which is inserted into the card connector 3 (refer to FIG. 1); the communication connector 4; the LCD panel 2; external peripheral switches S (i.e., which is a generic name of the start/stop button 8, the backstitch button 9, the needle up and down button 10 etc., shown in FIG. 1 which are the buttons for operating the embroidery sewing machine M from the external); the touch panel 25; the X direction driving motor 23; the Y direction driving motor 24; and so on.

Incidentally, the operation of the embroidery sewing machine M of the present embodiment is performed under the control of the CPU 16. The program corresponding to the processing operation indicated by each flow chart, which will be described later, and necessary for the control of the CPU 16 is stored in the ROM 17 in advance.

In the signal processing unit 15, there is equipped an EEPROM (Electrically Erasable/Programmable ROM) 26 for storing peculiar information such as the repair history information or the like related to the embroidery sewing machine M. The EEPROM 26 is adapted to electrically re-write the storage content and to maintain the storage content even after the electric source for the embroidery sewing machine M itself is turned off.

Next, the display implementation of the LCD panel 2 and the operation in relation to it of the embroidery sewing machine M will be explained below with reference to FIG. 3 to FIG. 5B.

At first, a picture plane for the sewing operation displayed on the LCD panel 2 is explained with reference to FIG. 3. Incidentally, FIG. 3 shows an example of the picture plane to select the pattern to be sewed.

Figure 3:
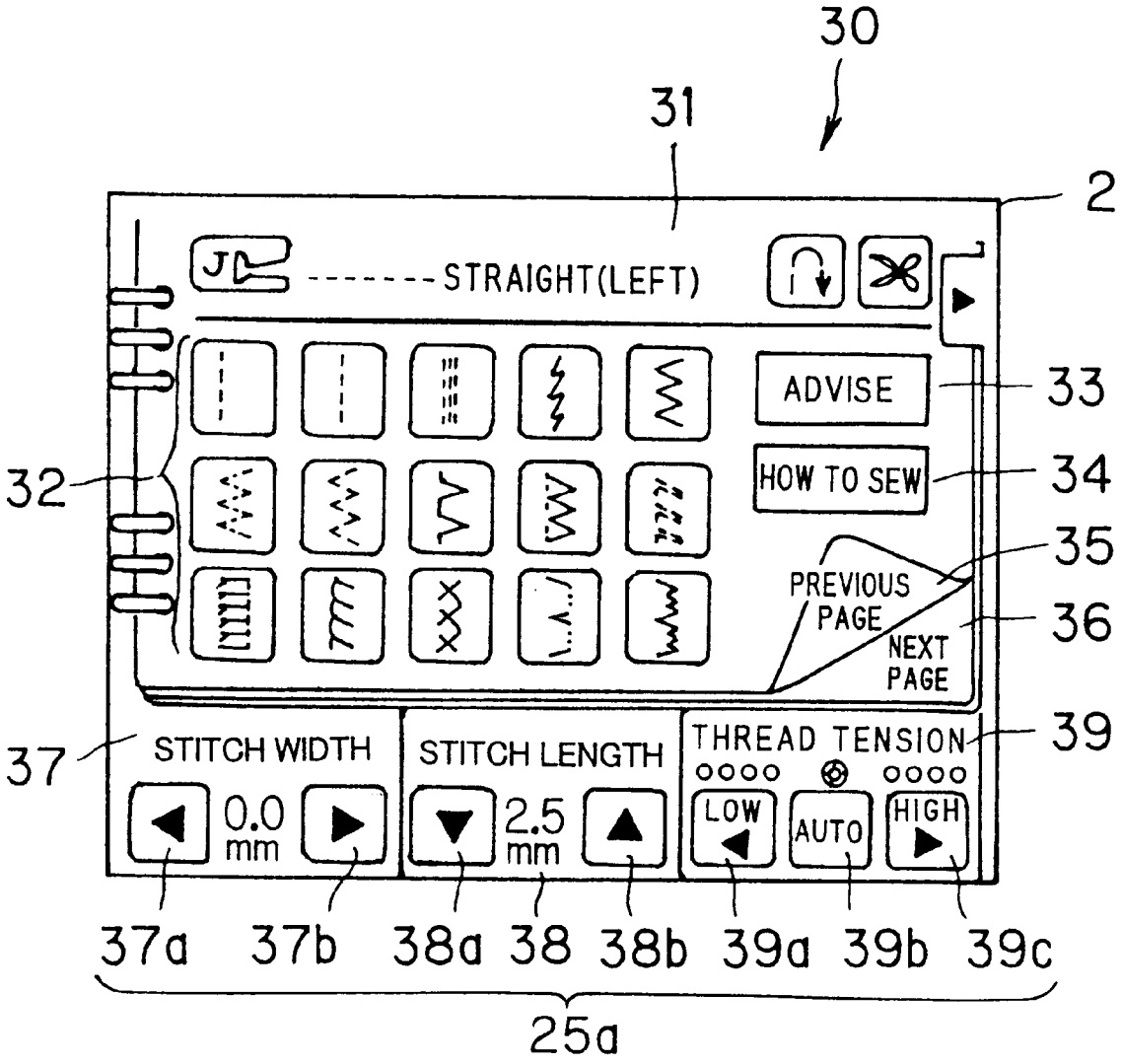
FIG. 3 is a plan view of an example of a picture plane for a selection in the embodiment.

As shown in FIG. 3, a selection picture plane 30 displayed on the LCD panel 2 when the sewing pattern is to be selected includes: a selection pattern display region 31 to display a presently selected sewing pattern; a plurality of pattern selection keys 32 operated when a pattern to be sewed is selected; an advice key 33 operated when information with regard to a method of using the embroidery sewing machine M is to be displayed; a sewing manner key 34 operated when how to sew is to be displayed; a previous page key 35 operated when a picture plane for a pattern selection located at a previous page on the display picture plane is to be displayed; a next page key 36 operated when a picture plane for a pattern selection located at a next page on the display picture plane is to be displayed; a stitch width adjustment region 37 on which keys to adjust a stitch width of the sewing needle 7 are displayed; a stitch length adjustment region 38 on which keys to adjust a stitch length are displayed; and a thread tension adjustment region 39 on which keys to adjust a tension of a sewed thread are displayed.

Among the above mentioned regions, in the switch width adjustment region 37, a stitch width increase key 37*b* operated when the stitch width is to be increased and a stitch width decrease key 37*a* when the stitch width is to be decreased are displayed.

In the stitch length adjustment region 38, an extension key 38*b* operated when the stitch length is to be extended and a reduction key 38*a* operated when the stitch length is to be reduced are displayed.

In the thread tension adjustment region 39, a high key 39*c* operated when the thread tension is to be made hard, a low key 39*a* operated when the thread tension is to be made soft and an automatic key 39*b* operated when the thread tension is to be initialized and automatically set are displayed.

Transparent switches constituted by transparent electrodes are disposed at the positions of the touch panel 25 corresponding to the respective keys of the selection picture plane 30.

The above mentioned respective keys are displayed by using different colors based on their functions.

That is, the respective pattern selection keys 32 are displayed by using a green color. The advice key 33 is displayed by using a yellow color. The sewing manner key 34 is displayed by using a pale blue color. The previous page key 35 is displayed by using a brown color. The next page key 36 is displayed by using an orange color. The stitch width increase key 37*b* and the stitch width decrease key 37 are displayed by using a violet color. The extension key 38*b* and the reduction key 38*a* are displayed by using a blue color. The high key 39*c* and the low key 39*a* are displayed by using a yellowish green color. The automatic key 39*b* is displayed by using a red color as a warning color.

The reason why only the automatic key 39*b* is displayed by using the red color as the warning color will be described later.

When the respective keys are displayed by using the above mentioned respective colors, the data for displaying each key in correlation with the respective one of display colors is stored in advance in the EEPROM 26. Then, the data is read out from the EEPROM 26 when the selection picture plane 30 is to be displayed. Accordingly, under the control of the CPU 16, the respective keys are displayed together with the selection picture plane 30. This key display is similarly performed on an adjustment picture plane 40 and a control picture plane 60, which will be described later.

Figure 4:
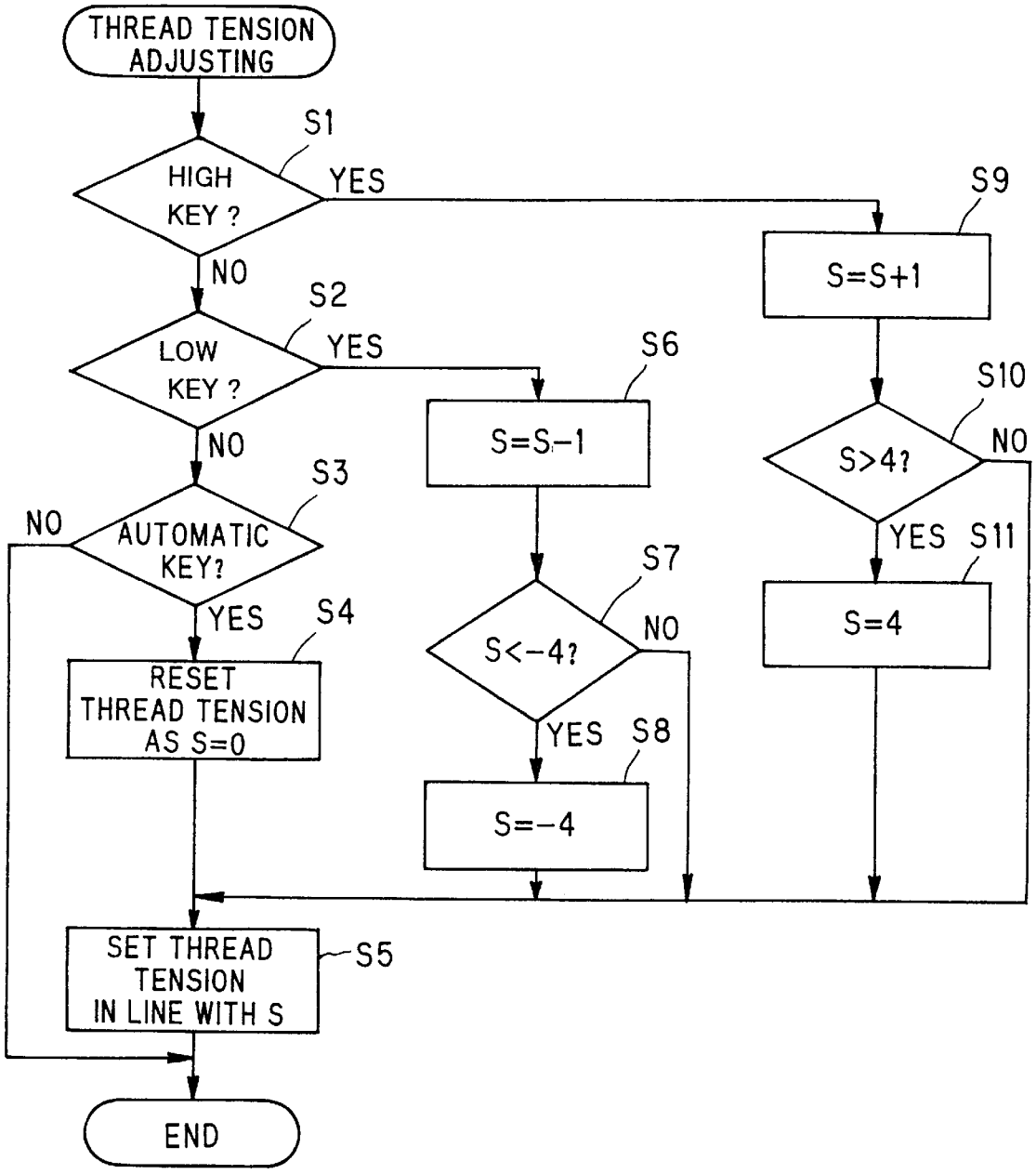
FIG. 4 is a flowchart showing a process of adjusting a thread tension in the embodiment.

Next, the Process of adjusting the thread tension by using the respective keys within the thread tension adjustment region 39 is firstly explained with reference to FIG. 4, before the reason why only the automatic key 39 is displayed by using the red color is explained. FIG. 4 is a flowchart to explain the operation of the CPU 16 when the thread tension is adjusted. Actually, a program (which is stored in advance in the ROM 17) corresponding to the flowchart is read out by the CPU 16. Then, the process of adjusting the thread tension is executed.

In the process of adjusting the thread tension, it is firstly judged whether or not the high key 39*c* is operated (Step S1). If the high key 39*c* is not operated (Step S1; NO), it is judged whether or not the low key 39*a* is operated (Step S2).

Then, if the low key 39*a* is not operated (Step S2; NO), it is judged whether or not the automatic key 39*b* is operated (Step S3). If the automatic key 39*b* is operated (Step S3; YES), a parameter S indicative of the thread tension is set to "0" so as to reset the thread tension and automatically set it (Step S4). Then, the thread tension is automatically set on the basis of the parameter S (Step S5). Then, the process is ended.

On the other hand, if the automatic key 39*b* is not operated in the judgment at the step S3 (Step S3; NO), the process is directly ended.

If the low key 39*a* is operated in the judgment at the step S2 (Step S2; YES), the parameter S is decremented by "1" (Step S6). Then, it is judged whether or not the decrement result becomes less than "−4" that is the minimum value of the parameter S (Step S7).

If the decrement result is not less than "−4" (Step S7; NO), the operational flow branches to the step S5. Then, the thread tension is set on the basis of the value of the parameter S of the decrement result.

On the other hand, if the decrement result is less than "−4" in the judgment at the step S7 (Step S7; YES), the parameter S is set to "−4" of the minimum value (Step S8) since the thread tension cannot be made further lower. Then, the operational flow proceeds to the step S5. Then, the thread tension is set on the basis of the minimum value.

On the other hand, if the high key 39*c* is operated in the judgment at the step S1 (Step S1; YES), the parameter S is incremented by "1" (Step S9). Then, it is judged whether or not the increment result becomes greater than "4" that is the maximum value of the parameter S (Step S10).

If the increment result is not greater than "4" (Step S10; NO), the operational flow branches to the step S5. Then, the thread tension is set on the basis of the value of the parameter S of the increment result.

On the other hand, if the increment result is greater than "4" in the judgment at the step S10 (Step S10; YES), the parameter S is set to "4" of the maximum value (Step S11) since the thread tension cannot be made further higher. Then, the operational flow proceeds to the step S5. Then, the thread tension is set on the basis of the maximum value.

As explained above, if the automatic key 39*b* is operated in the thread tension adjustment using the high key 39*c*, the low key 39*a* and the automatic key 39*b*, the value set until that time (i.e., the value of the parameter S) is initialized (cleared), and the thread tension is automatically set. That is, if the automatic key 39*b* is erroneously operated during the manual set of the thread tension by means of the high key 39*c* or the low key 39*a*, the value which has been set manually until that time is invalidated. Hence, in the present embodiment, the display color only for the automatic key 39*b* is defined as the red color implying the warning color. Accordingly, the user is prompted to pay attention so that the automatic key 39*b* is not carelessly operated.

Next, the application of the present invention to other examples of the picture planes displayed on the LCD panel 2 will be explained with reference to FIG. 5A and FIG. 5B.

At first, an adjustment picture plane to adjust the sewing position of the sewing needle 7 is explained with reference to FIG. 5A.

Figure 5A:
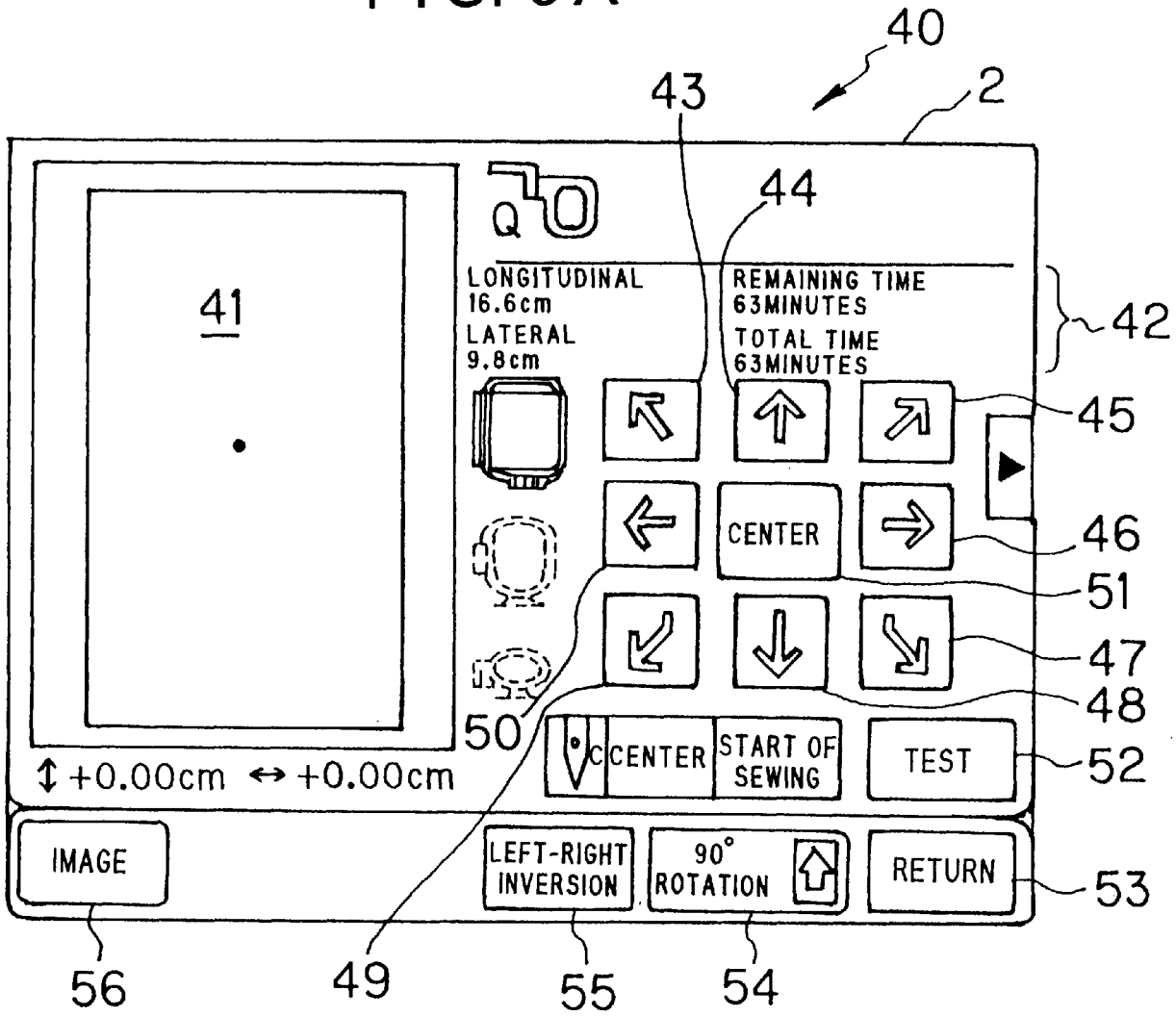
FIG. 5A is a plan view of an example of a picture plane for an adjustment in the embodiment.

As shown in FIG. 5A, the adjustment picture plane 40 is provided with; a position display region 41 to actually display the position of the sewing needle 7 on the cloth; a progress display region 42 to display a size of an embroidery pattern to be sewed up, a required total time to complete sewing and a required remaining time to complete sewing; a movement key 43 operated when the sewing needle 7 is to be moved obliquely in an upper left direction on the cloth; a movement key 44 operated when the sewing needle 7 is to be moved in an upper direction on the cloth; a movement key 45 operated when the sewing needle 7 is to be moved obliquely in an upper right direction on the cloth; a movement key 46 operated when the sewing needle 7 is to be moved in a right direction on the cloth; a movement key 47 operated when the sewing needle 7 is to be moved obliquely in a tower right direction on the cloth; a movement key 48 operated when the sewing needle 7 is to be moved in a lower direction on the cloth; a movement key 49 operated when the sewing needle 7 is to be moved obliquely in a lower left direction on the cloth; a movement key 50 operated when the sewing needle 7 is to be moved in a left direction on the cloth; a center key 51 operated when the sewing needle 7 is to be returned to a central position of the cloth; a test key 52 operated when a test sewing operation is to be executed; a return key 53 operated when a picture plane located at a previous page on the display picture plane is to be displayed; a rotation key 54 operated when the embroidery pattern is to be rotated by 90 degrees and then sewed; an inversion key 55 operated when the left/right side of the embroidery pattern is to be inverted; and an image key 56 operated when an image of the embroidery to be completed is to be displayed.

Transparent switches constituted by transparent electrodes are disposed at the positions of the touch panel 25 corresponding to the respective keys of the adjustment picture plane 40.

The respective keys are displayed by using different colors based on their functions, similarly to those of the selection picture plane 30. For example, the moving keys 43 to 50 are displayed by using the green color. The center key 51 and the return key 53 are displayed by using the red color implying the warning color. The test button is displayed by using the blue color. The rotation key 54 is displayed by using the yellow color. The inversion key 55 is displayed by using the brown color. And, the image key 56 is displayed by using the violet color.

At this time, the reason why the center key 51 is displayed by using the red color is described below. That is, when the center key 51 is operated, the position of the sewing needle 7 which has been moved by using the moving keys 43 to 50 until that time is initialized and returned to the central position of the cloth. Thus, the position set manually by using the moving keys 43 to 51 until that time is invalidated. So, the user must be prompted to pay attention so that the center key 51 is not carelessly operated.

Moreover, the reason why the return key S is displayed by using the red color is that when the return key 53 is operated, the position set of the sewing needle 7 until that time is invalidated, and is moved to another selection picture plane and the like. So, the user must be prompted to pay attention so that the return key 53 is not carelessly operated.

Next, the example in which the present invention is applied to the picture plane to control the embroidery where a plurality of threads having different colors are used is explained below with reference to FIG. 5B.

Figure 5B:
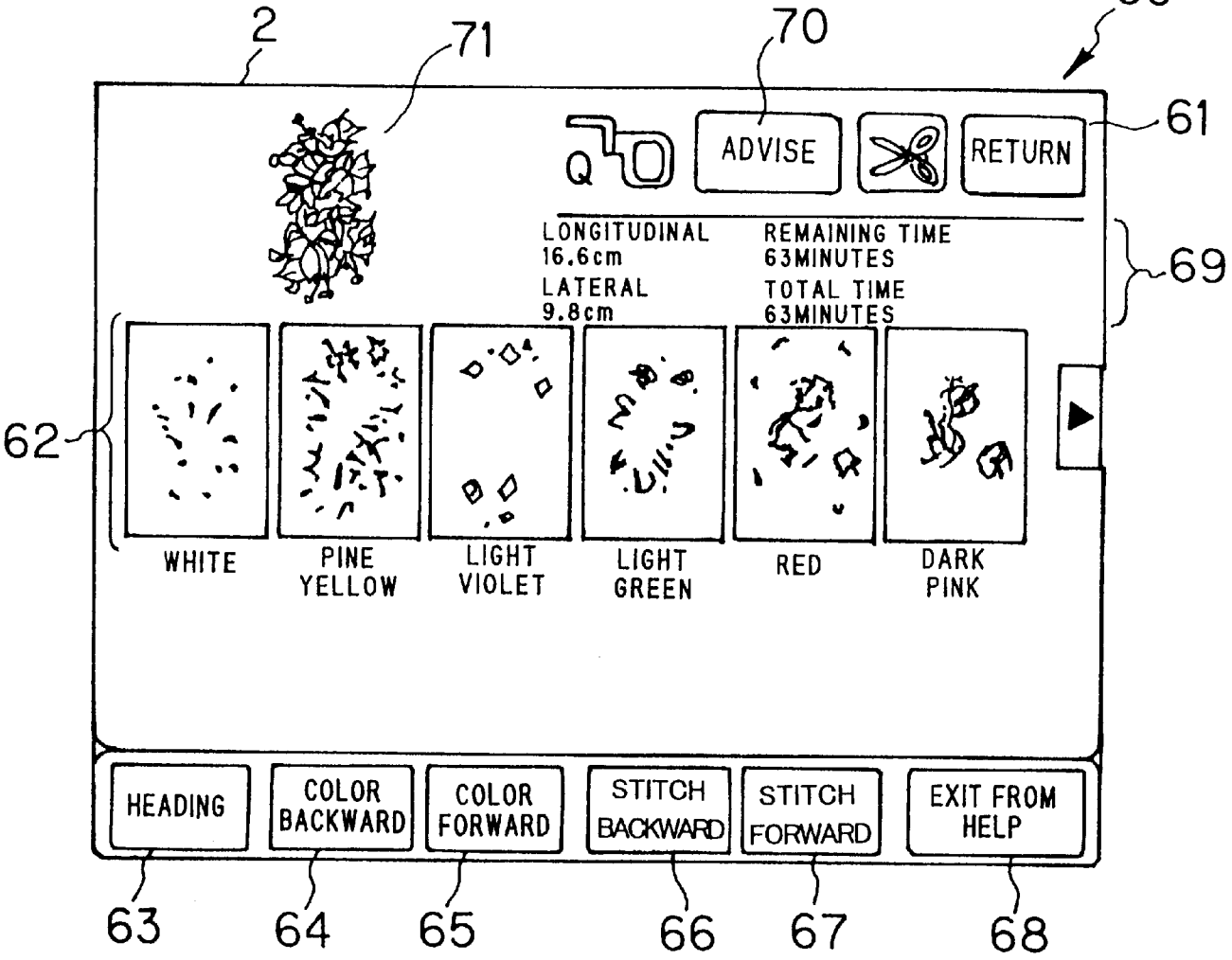
FIG. 5B is a plan view of an example of a picture plane for a control in the embodiment.

A control picture plane 60 shown in FIG. 5B is a picture plane to control the sewing operation for each color of the embroidery in which many colors are used. The control picture plane 60 is provided with: a completion embroidery display region 71 to display with colors the embroidery at the completion state; an advice key 70 operated when the information with regard to the method of using the embroidery sewing machine M is to be displayed; a return key 61 operated when the picture plane located at the previous page on the display picture plane is to be displayed; a pattern display region 62 to display a pattern to be sewed up for each color; a heading key 63 operated when a heading operation is to be performed for each color; a color backward key 64 operated when the sewing needle 7 is to be returned to a head position for each color or returned to a head position to be sewed with the thread of one color earlier; a color forward key 65 operated when the sewing needle 7 is to be moved to a head position to be sewed with the thread of one color later; a stitch backward key 66 operated when the sewing needle 7 is to be returned stitch by stitch for each color; a stitch forward key 67 operated when the sewing needle 7 is to be advanced stitch by stitch in the embroidery for each color; an exit from help key 68 through which when the explanation picture plane of an operation procedure is displayed, the display is ended; and a progress display region 69 to display the size of the embroidery pattern to be sewed up, the required total time for sewing and the required remaining time.

Incidentally, a character string describing a function of each key is displayed on the same position as each key.

Transparent switches constituted by transparent electrodes are disposed at the positions of the touch panel 25 corresponding to the respective keys of the control picture plane 60.

The respective keys are displayed by using different colors based on their functions, similarly to those of the selection picture plane 30 (refer to FIG. 3) or the adjustment picture plane 40 (refer to FIG. 5A). For example, the return key 61, the color backward key 64 and the color forward key 65 are displayed by using the red color. The advice key 70 is displayed by using the yellow color. The heading key 63 is displayed by using the blue key. The stitch backward key 66 and the stitch forward key 67 are displayed by using the green color. The exit from help key 68 is displayed by using the brown color.

At this time, the reason why the return key 61 is displayed by using the red color is that when the return key 61 is operated, the progress of the embroidery until that time is invalidated, and the position set is moved to another selection picture plane and the like. So, the user must be prompted to pay attention so that the return key 61 is not carelessly operated.

The reason why the color backward key 64 and the color forward key 65 are displayed by using the red color which is different from that of the stitch backward key 66 and the stitch forward key 67 is described below. That is, the color backward key 64 and the color forward key 65 are similar to the stitch backward key 66 and the stitch forward key 67, in the function of advancing forward (or returning backward) the stitch (the meaning of the character strings displayed on the color backward key 64 and the color forward key 65 and the meaning of the character strings displayed on the stitch backward key 66 and the stitch forward key 67 mutually imply the similar meaning). However, as for the color backward key 64, when it is operated, the result sewed up until that time is invalidated even during the embroidering process for each color. Then, the sewing needle 7 is returned back to a head position in each color or returned back to a head position sewed with a thread of one color earlier. On the other hand, as for the color forward key 65, when it is operated, the result sewed up until that time is invalidated even during the embroidering process for each color. Then, the sewing needle 7 is moved to a head position sewed with a thread of one color later. In any case, the result of the embroidering process until that time is invalidated. So, the user must be prompted to pay attention so that the color backward key 64 and the color forward key 65 are not carelessly operated because they are liable to be mistaken for the stitch backward key 66 and the stitch forward key 67. Incidentally, since the color backward key 64 and the color forward key 65 are displayed by using the red color, this also has a function of protecting against the erroneous operation resulting from the fact that the meaning of each button is erroneously understood because of the character string displayed simultaneously with each key.

As mentioned above, according to the embroidery sewing machine M of the embodiment, the respective keys are displayed on the LCD panel 2 such that the colors thereof are different from each other on the basis of the functions of the embroidery sewing machine M. Thus, each key can be visually recognized according to its function to thereby reduce the probability that each key is erroneously operated or protect against the erroneous operation.

Among the respective keys, a plurality of keys in which the contents implied by the corresponding character strings are apt to be mutually misunderstood (for example, the set of the color backward key 64 and the color forward key 65 and the set of the stitch backward key 66 and the stitch forward key 67) are displayed by using the colors different from each other. Thus, it is possible to reduce the probability of the erroneous operation with regard to the key displayed together with the character string having the misleading content or protect against the erroneous operation.

Moreover, the keys having the initializing function, such as the center key 51 and the like, are displayed by using the red color implying the warning. Hence, it is possible to reduce the probability that the erroneous operation of the key having the initializing function invalidates the operations which have been performed until that time.

Incidentally, the configuration in which the single embroidery sewing machine M having the touch panel 25 and the LCD panel 2 is explained in the embodiment. In addition, the present invention can be applied to a sewing apparatus in which a plurality of embroidery sewing machines M are collectively controlled by a computer C servicing as a single controller, as shown in FIG. 6.

Figure 6:
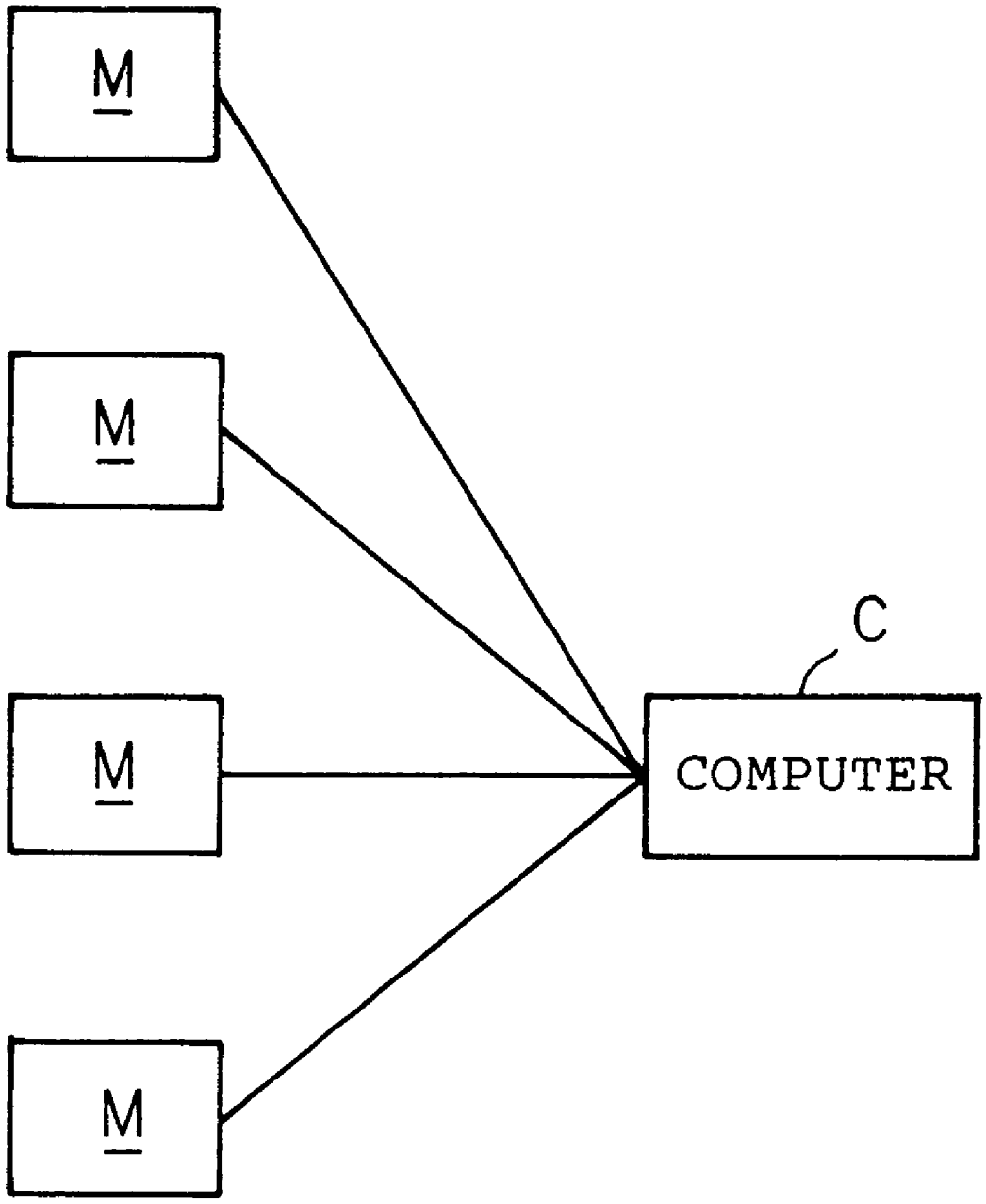
FIG. 6 is a block diagram showing a configuration of a sewing apparatus including a plurality of embroidery sewingmachines as a modified embodiment of the present invention.

In FIG. 6, each sewing machine M is collectively controlled through a communication line by the computer C such as a personal computer or the like. In this case, the picture planes shown in FIG. 4, 5A or 5B and the like are displayed on a displaying device such as a CRT (Cathode Ray Tube) device, an LCD device or the like of the computer C. It is also possible to construct the sewing apparatus such that some portion of the picture planes shown in FIG. 4, 5A or 5B is displayed on a displaying device equipped to each sewing machine M while the remaining or full port ion of the picture planes shown in FIG. 4, 5A or 5B are displayed on the displaying device of the computer C.

The case in which the touch panel 25 is a so-called digital type touch panel which includes a plurality of keys constituted by the transparent switches is explained in the embodiment. In addition, the present invention can be applied to even a case in which the touch panel 25 is a so-called analog type touch panel wherein the resistance variations resulting from the entirely pushed pressure are accumulated and thereby a position of the pushed pressure is detected from an infinite number of (unspecified) positions on the touch panel 25, by changing the colors displayed by the respective keys.

As explained above, according to the present embodiment, the transparent switches, keys, buttons or the like are displayed on the displaying device such that the colors are different based on the functions of the sewing apparatus. Thus, each transparent switch can be visually recognized according to its function to thereby reduce the probability that each transparent switch is erroneously operated or protect against the erroneous operation.

Therefore, it is possible to reduce or protect against such an obstacle that the position of the sewing needle is unexpectedly returned to the initial position because of the erroneous operation on the sewing apparatus.

The invention may be embodied in other specific forms without departing from the spirit or essential characteristics thereof. The present embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

The entire disclosure of Japanese Patent Application No. 09-264700 filed on Sep. 29, 1997 including the specification, claims, drawings and summary is incorporated herein by reference in its entirety.

What is claimed is:

1. A sewing apparatus comprising:

a stitch forming device;

a driving device for driving said stitch forming device;

a controller for controlling said driving device;

a displaying device comprising a color switch panel including a plurality of transparent switches on a surface of said color switch panel, said transparent switches being divided into a plurality of switch groups, each of which includes at least one transparent switch, depending upon functions of said sewing apparatus corresponding to said transparent switches respectively; and a color display controlling device for controlling said displaying device to perform a color display on said color switch panel by using one color for all of said at least one transparent switch belonging to one of the switch groups and by using another color for all of said at least one transparent switch belonging to another of the switch groups.

2. A sewing apparatus comprising:

a stitch forming device;

a driving device for driving said stitch forming device;

a controller for controlling said driving device;

a displaying device comprising a color switch panel including a plurality of transparent switches on a surface of said color switch panel, said transparent switches being divided into a plurality of switch groups, each of which includes at least one transparent switch;

a character display controlling device for controlling said displaying device to perform a character display such that each of at least a character string, which corresponds to a respective one of functions of said sewing apparatus corresponding to said transparent switches respectively, is displayed at a position corresponding to respective one of said transparent switches; and a color display controlling device for controlling said displaying device to perform a color display on said color switch panel by using one color for all of said at least one transparent switch belonging to one of the switch groups and by using another color for all of said at least one transparent switch belonging to another of the switch groups such that transparent switches whose meanings are confusing to each other according to a predetermined standard, are displayed by using colors different from each other.

3. A sewing apparatus according to claim 1, wherein said color display controlling device controls said displaying device to perform the color display by using a predetermined color implying a warning for said at least one transparent switch belonging to one switch group having an initializing function which initializes operations having been performed on said sewing apparatus.

4. A sewing apparatus according to claim 2, wherein said color display controlling device controls said displaying device to perform the color display by using a predetermined color implying a warning for said at least one transparent switch belonging to one switch group having an initializing function which initializes operations having been performed on said sewing apparatus.

5. A sewing apparatus according to claim 3, wherein the predetermined color implying the warning is red.

6. A sewing apparatus according to claim 4, wherein the predetermined color implying the warning is red.

7. A sewing apparatus comprises (i) at least one sewing machine each comprising a stitch forming device and a driving device for driving said stitch forming device, and (ii) a control unit connected to said sewing machine from an external portion of said sewing machine through a communication line, said control unit comprising:

a controller for controlling said driving device;

a displaying device comprising a color switch panel including a plurality of transparent switches on a surface of said color switch panel, said transparent switches being divided into a plurality of switch groups, each of which includes at least one transparent switch, depending upon functions of said sewing apparatus corresponding to said transparent switches respectively; and a color display controlling device for controlling said displaying device to perform a color display on said color switch panel by using one color for all of said at least one transparent switch belonging to one of the switch groups and by using another color for all of said at least one transparent switch belonging to another of the switch groups.

8. A sewing apparatus comprising (i) at least one sewing machine each comprising a stitch forming device and a driving device for driving said stitch forming device, and (ii) a control unit connected to said sewing machine from an external portion of said sewing machine through a communication line, said control unit comprising:

a controller for controlling said driving device;

a displaying device comprising a color switch panel including a plurality of transparent switches on a surface of said color switch panel, said transparent switches being divided into a plurality of switch groups, each of which includes at least one transparent switch;

a character display controlling device for controlling said displaying device to perform a character display such that each of at least a character string, which corresponds to a respective one of functions of said sewing apparatus corresponding to said transparent switches respectively, is displayed at a position corresponding to respective one of said transparent switches; and a color display controlling device for controlling said displaying device to perform a color display on said color switch panel by using one color for all of said at least one transparent switch belonging to one of the switch groups and by using another color for all of said at least one transparent switch belonging to another of the switch groups such that transparent switches whose meanings are confusing to each other according to a predetermined standard, are displayed by using colors different from each other.

9. A sewing apparatus according to claim 7, wherein said color display controlling device controls said displaying device to perform the color display by using a predetermined color implying a warning for said at least one transparent switch belonging to one switch group having an initializing function which initializes operations having been performed on said sewing apparatus.

10. A sewing apparatus according to claim 8, wherein said color display controlling device controls said displaying device to perform the color display by using a predetermined color implying a warning for said at least one transparent switch belonging to one switch group having an initializing function which initializes operations having been performed on said sewing apparatus.

11. A sewing apparatus according to claim 9, wherein the predetermined color implying the warning is red.

12. A sewing apparatus according to claim 10, wherein the predetermined color implying the warning is red.

13. A sewing apparatus comprising:

a stitch forming means;

a driving means for driving said stitch forming means;

a control means for controlling said driving means;

a displaying means comprising a color switch panel including a plurality of transparent switches on a surface of said color switch panel, said transparent switches being divided into a plurality of switch groups, each of which includes at least one transparent switch, depending upon functions of said sewing apparatus corresponding to said transparent switches respectively; and a color display controlling means for controlling said displaying means to perform a color display on said color switch panel by using one color for all of said at least one transparent switch belonging to one of the switch groups and by using another color for all of said at least one transparent switch belonging to another of the switch groups.

14. A sewing apparatus comprising:

a stitch forming means;

a driving means for driving said stitch forming means;

a control means for controlling said driving means;

a displaying means comprising a color switch panel including a plurality of transparent switches on a surface of said color switch panel, said transparent switches being divided into a plurality of switch groups, each of which includes at least one transparent switch;

a character display controlling means for controlling said displaying means to perform a character display such that each of at least a character string, which corresponds to a respective one of functions of said sewing apparatus corresponding to said transparent switches respectively, is displayed at a position corresponding to respective one of said transparent switches; and a color display controlling means for controlling said displaying means to perform a color display on said color switch panel by using one color for all of said at least one transparent switch belonging to one of the switch groups and by using another color for all of said at least one transparent switch belonging to another of the switch groups such that transparent switches whose meanings are confusing to each other according to a predetermined standard, are displayed by using colors different from each other.

15. A sewing apparatus comprises (i) at least one sewing machine each comprising a stitch forming means and a driving means for driving said stitch forming means, and (ii) a control unit connected to said sewing machine from an external portion of said sewing machine through a communication line, said control unit comprising:

a control means for controlling said driving means;

a displaying means comprising a color switch panel including a plurality of transparent switches on a surface of said color switch panel, said transparent switches being divided into a plurality of switch groups, each of which includes at least one transparent switch, depending upon functions of said sewing apparatus corresponding to said transparent switches respectively; and a color display controlling means for controlling said displaying means to perform a color display on said color switch panel by using one color for all of said at least one transparent switch belonging to one of the switch groups and by using another color for all of said at least one transparent switch belonging to another of the switch groups.

16. A sewing apparatus comprising (i) at least one sewing machine each comprising a stitch forming means and a driving means for driving said stitch forming means, and (ii) a control unit connected to said sewing machine from an external portion of said sewing machine through a communication line, said control unit comprising:

a control means for controlling said driving means;

a displaying means comprising a color switch panel including a plurality of transparent switches on a surface of said color switch panel, said transparent switches being divided into a plurality of switch groups, each of which includes at least one transparent switch;

a character display controlling means for controlling said displaying means to perform a character display such that each of at least a character string, which corresponds to a respective one of functions of said sewing apparatus corresponding to said transparent switches respectively, is displayed at a position corresponding to respective one of said transparent switches; and a color display controlling means for controlling said displaying means to perform a color display on said color switch panel by using one color for all of said at least one transparent switch belonging to one of thc switch groups and by using another color for all of said at least one transparent switch belonging to another of the switch groups such that transparent switches whose meanings are confusing to each other according to a predetermined standard, are displayed by using colors different from each other.

* * * * *